US011654943B2

(12) United States Patent
Swar et al.

(10) Patent No.: US 11,654,943 B2
(45) Date of Patent: May 23, 2023

(54) END OF VEHICLE DEVICE WITH INTEGRATED ANTENNA

(71) Applicant: Westinghouse Air Brake Technologies Corporation, Wilmerding, PA (US)

(72) Inventors: Padam Dhoj Swar, Clarksburg, MD (US); Benjamin L. Henniges, Mt. Airy, MD (US); Michael B. Colson, Woodbine, MD (US); Carl L. Haas, Walkersville, MD (US); David Andrew Gloyd, Ellicott City, MD (US)

(73) Assignee: WESTINGHOUSE AIR BRAKE TECHNOLOGIES CORPORATION, Wilmerding, PA (US)

( * ) Notice: Subject to any disclaimer, the term of this patent is extended or adjusted under 35 U.S.C. 154(b) by 815 days.

(21) Appl. No.: 16/164,338

(22) Filed: Oct. 18, 2018

(65) Prior Publication Data

US 2020/0122756 A1 Apr. 23, 2020

(51) Int. Cl.
*B61L 15/00* (2006.01)

(52) U.S. Cl.
CPC ..... *B61L 15/0054* (2013.01); *B61L 15/0018* (2013.01)

(58) Field of Classification Search
CPC ..... B61L 15/0054; B61L 15/0018; B61L 15/0027; B61L 15/00; H01Q 1/40; H01Q 1/405; H01Q 1/44; H01Q 1/46; H01Q 1/243; H01Q 1/32; H01Q 1/3208; H01Q 1/325; H01Q 1/3258; H01Q 1/3275; H01Q 1/3291
See application file for complete search history.

(56) References Cited

U.S. PATENT DOCUMENTS 5,235,849 A * 8/1993 Egerton ..... B61L 15/02 73/129
5,873,638 A * 2/1999 Bezos ..... B60T 13/665 303/47
5,960,592 A * 10/1999 Lilienthal, II ..... E04H 1/1238 52/79.5
6,081,769 A * 6/2000 Curtis ..... B61L 1/14 246/122 R
2006/0272539 A1* 12/2006 Clavel ..... E01B 35/00 104/137
2011/0183605 A1* 7/2011 Smith, Jr. ..... H04L 1/1867 455/7
2011/0251742 A1* 10/2011 Haas ..... H04N 7/183 701/19
2020/0107141 A1* 4/2020 Kvist ..... H01Q 9/00

FOREIGN PATENT DOCUMENTS

DE 102011086609 * 5/2012 ..... E05B 81/77

* cited by examiner

*Primary Examiner* — Mark T Le
(74) *Attorney, Agent, or Firm* — The Small Patent Law Group LLC; Christopher R. Carroll

(57) ABSTRACT

A device adapted for attachment to a coupler of a trailing railcar of a train includes an enclosure defining an internal compartment, a port adapted for connection to an air brake hose receiving air from a brake pipe of the train, a handle extending from the enclosure, a communication device disposed within the internal compartment of the enclosure, and at least one antenna connected to the communication device and extending at least partially through the internal compartment of the enclosure and into an internal cavity of the handle.

17 Claims, 7 Drawing Sheets

END OF VEHICLE DEVICE WITH INTEGRATED ANTENNA

BACKGROUND OF THE INVENTION

Field of the Invention

The present invention relates to the field of rail car end of train devices and, in particular, an end of train device having an integrated antenna. The present invention also relates to a rail car system having an end of train device with an integrated antenna.

Description of Related Art

Rail car transportation of goods and people is a ubiquitous and essential part of modern economies. Train systems typically include one or more locomotives driving a series of freight cars and, optionally, any number of specialized cars. The train system including the locomotives and all of the cars coupled thereto is referred to as a consist. The brake system of a train typically includes a brake pipe extending along the length of the consist and branching off at each rail car to supply pressure for activating the brake. In some train arrangements, an end of train (hereinafter "EOT") device is attached to the final car in the consist and receives pressure from the brake pipe. The EOT device typically includes a sensor for measuring the pressure at the brake pipe and a transceiver for communicating the brake pipe pressure to a control unit in the locomotive. As such, an operator or control unit in the locomotive is able to monitor the state of brake pipe pressure at the rear of the consist and can deduce from the best brake pipe pressure if the EOT device has detached or if a car in the consist has derailed. The resulting loss in brake pipe pressure can be used to stop the train.

EOT devices typically communicate with the locomotive wirelessly via an antenna. To keep pace with freight companies increasing length of the consist to include more and more cars, the EOT devices must be capable of communication over a greater distance. One solution to improve communication is simply to increase the length of the antenna mounted to the EOT device. However, such length increases often require external mounting of the antennas, which unfavorably subjects the antennas to harsh environmental conditions including dust, weather, vibration, and impact. All of these factors can lead to damage and/or compromised performance of the antennas.

SUMMARY OF THE INVENTION

In view of the foregoing deficiencies, there exists a need for EOT devices having improved communication ranges. Moreover, there exists a need for EOT devices with large antennas which are nevertheless protected from environmental conditions. Additionally, there exists a need for a rail car system utilizing such EOT devices.

Non-limiting embodiments of the prevent invention are directed to a device adapted for attachment to a coupler of a trailing railcar of a train. The device includes an enclosure defining an internal compartment, a port adapted for connection to an air brake hose receiving air from a brake pipe of the train, a handle extending from the enclosure, a communication device disposed within the internal compartment of the enclosure, and at least one antenna connected to the communication device and extending at least partially through the internal compartment of the enclosure and into an internal cavity of the handle.

In some non-limiting embodiments, the at least one antenna includes a monopole antenna including a single conducting rod.

In some non-limiting embodiments, the at least one antenna includes a dipole antenna including two conducting rods attached to one another at a junction.

In some non-limiting embodiments, the at least one antenna includes a first primary antenna and a second diversity antenna.

In some non-limiting embodiments, the communication device includes a first communication device connected to the first primary antenna and a second communication device connected to the second diversity antenna.

In some non-limiting embodiments, the handle is spaced apart from the enclosure via one or more struts. A channel extends through at least one of the one or more struts to connect the internal cavity of the handle to the internal compartment of the enclosure.

Other non-limiting embodiments of the prevent invention are directed to a device adapted for attachment to a coupler of a trailing railcar of a train. The device includes an enclosure defining an internal compartment, a port adapted for connection to an air brake hose receiving air from a brake pipe of the train, a communication device disposed within the internal compartment of the enclosure, and at least one antenna connected to the communication device and disposed in at least a portion of the enclosure or in at least a portion of the air brake hose connected to the port.

In some non-limiting embodiments, the at least one antenna includes at least one of a monopole antenna or a dipole antenna.

In some non-limiting embodiments, the at least one antenna includes a first primary antenna and a second diversity antenna.

In some non-limiting embodiments, the communication device includes a first communication device connected to the first primary antenna and a second communication device connected to the second diversity antenna.

In some non-limiting embodiments, the enclosure includes at least one sidewall defining an internal cavity. The at least one antenna is at least partially disposed in the internal cavity of the at least one sidewall.

In some non-limiting embodiments, the at least one sidewall of the enclosure defines a channel connecting the internal cavity of the sidewall to the internal compartment of the enclosure. The at least one antenna extends through the channel of the at least one sidewall into the internal cavity of the at least one sidewall.

In some non-limiting embodiments, a flexible wall of the air brake hose defines an internal cavity in the air brake hose. The at least one antenna is at least partially disposed in the internal cavity of the air brake hose.

In some non-limiting embodiments, the port defines a channel connecting the internal cavity of the air brake hose to the internal compartment of the enclosure. The at least one antenna extends through the channel of the port into the internal cavity of the air brake hose.

Other non-limiting embodiments of the prevent invention are directed to a train system including a plurality of railcars connected in a series, at least one locomotive connected in series to the plurality of rail cars and including a receiver adapted to receive wireless communication, a brake pipe adapted to supply pressurized air to each of the plurality of railcars, and an end of train device affixed to a coupler of a trailing railcar of the plurality of railcars. The end of train device includes an enclosure defining an internal compartment, a port connected to an air brake hose receiving air from the brake pipe, a communication device disposed within the internal compartment of the enclosure, and at least one antenna adapted to transmit signals from the communication device to the receiver of the at least one locomotive. The a least one antenna is disposed in at least a portion of the enclosure or in at least a portion of the air brake hose connected to the port of the enclosure.

In some non-limiting embodiments, the at least one antenna includes a first primary antenna and a second diversity antenna.

In some non-limiting embodiments, the enclosure of the end of train device includes a handle having an internal cavity. The at least one antenna is at least partially disposed in the an internal cavity of the handle.

In some non-limiting embodiments, the enclosure includes at least one sidewall having an internal cavity. The at least one antenna is at least partially disposed in the internal cavity of the at least one sidewall.

In some non-limiting embodiments, a flexible wall of the air brake hose defines an internal cavity in the air brake hose. The at least one antenna is at least partially disposed in the internal cavity of the air brake hose.

In some non-limiting embodiments, the port of the end of train device defines a channel connecting the internal cavity of the air brake hose to the internal compartment of the enclosure. The at least one antenna extends through the channel of the port into the internal cavity of the air brake hose.

These and other features and characteristics of EOT devices and implementations of the same in a train system will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the disclosure. As used in the specification and claims, the singular forms of "a", "an", and "the" include plural referents unless the context clearly dictates otherwise.

DESCRIPTION OF THE INVENTION

Figure 3:
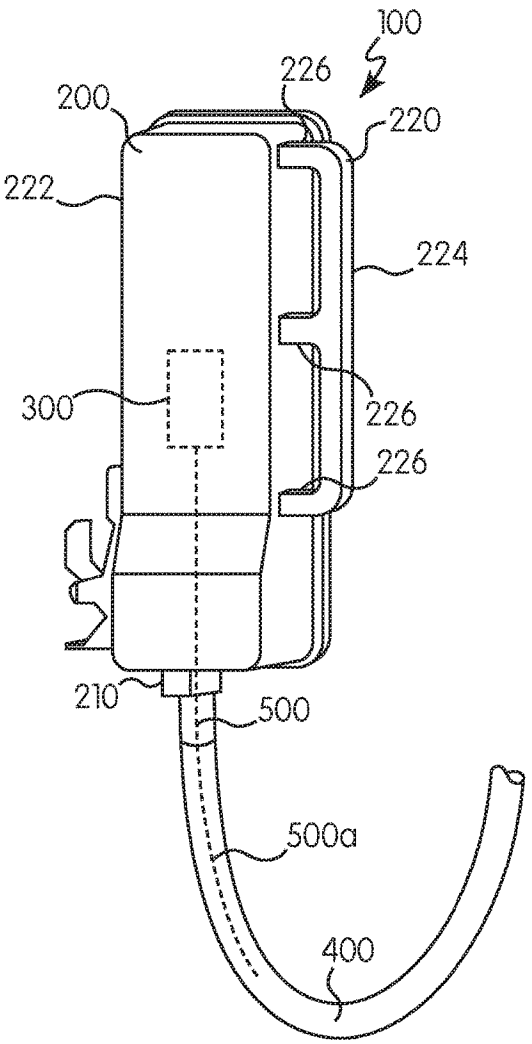
FIG. 3 is a perspective view of an EOT device according to an embodiment of the present invention.

As used herein, spatial or directional terms, such as "inner", "outer", "left", "right", "up", "down", "horizontal", "vertical", "lateral", "forward", "backward", "rearward", and the like, relate to the invention as it is shown in the drawing figures. However, it is to be understood that the invention can assume various alternative orientations and, accordingly, such terms are not to be considered as limiting. It is also to be understood that the specific apparatuses and configurations illustrated in the attached drawings and described in the following specification are simply exemplary embodiments of the invention. Hence, specific dimensions and other physical characteristics related to the embodiments disclosed herein are not to be considered as limiting, unless otherwise indicated.

As used herein, the term "at least one of" is synonymous with "one or more of". For example, the phrase "at least one of A, B, and C" means any one of A, B, and C, or any combination of any two or more of A, B, and C. For example, "at least one of A, B, and C" includes one or more of A alone; or one or more B alone; or one or more of C alone; or one or more of A and one or more of B; or one or more of A and one or more of C; or one or more of B and one or more of C; or one or more of all of A, B, and C. Similarly, as used herein, the term "at least two of" is synonymous with "two or more of". For example, the phrase "at least two of D, E, and F" means any combination of any two or more of D, E, and F. For example, "at least two of D, E, and F" includes one or more of D and one or more of E; or one or more of D and one or more of F; or one or more of E and one or more of F; or one or more of all of D, E, and F.

As used herein, the terms "communication" and "communicate" may refer to the reception, receipt, transmission, transfer, provision, and/or the like, of information (e.g., data, signals, messages, instructions, commands, and/or the like). For one unit (e.g., a device, a system, a component of a device or system, combinations thereof, and/or the like) to be in communication with another unit means that the one unit is able to directly or indirectly receive information from and/or transmit information to the other unit. This may refer to a direct or indirect connection (e.g., a direct communication connection, an indirect communication connection, and/or the like) that is wired and/or wireless in nature. Additionally, two units may be in communication with each other even though the information transmitted may be modified, processed, relayed, and/or routed between the first and second unit. For example, a first unit may be in communication with a second unit even though the first unit passively receives information and does not actively transmit information to the second unit. As another example, a first unit may be in communication with a second unit if at least one intermediary unit (e.g., a third unit located between the first unit and the second unit) processes information received from the first unit and communicates the processed information to the second unit. In some aspects, a message may refer to a network packet (e.g., a data packet, and/or the like) that includes data. It will be appreciated that numerous other arrangements are possible.

As used herein, the term "diversity antenna" and derivatives thereof may refer to one antenna in a system of more than one antennas. The diversity antenna may be used as a supplement to a primary antenna of the system to improve the quality and reliability of the communication from the primary antenna to a receiver.

Figure 1:
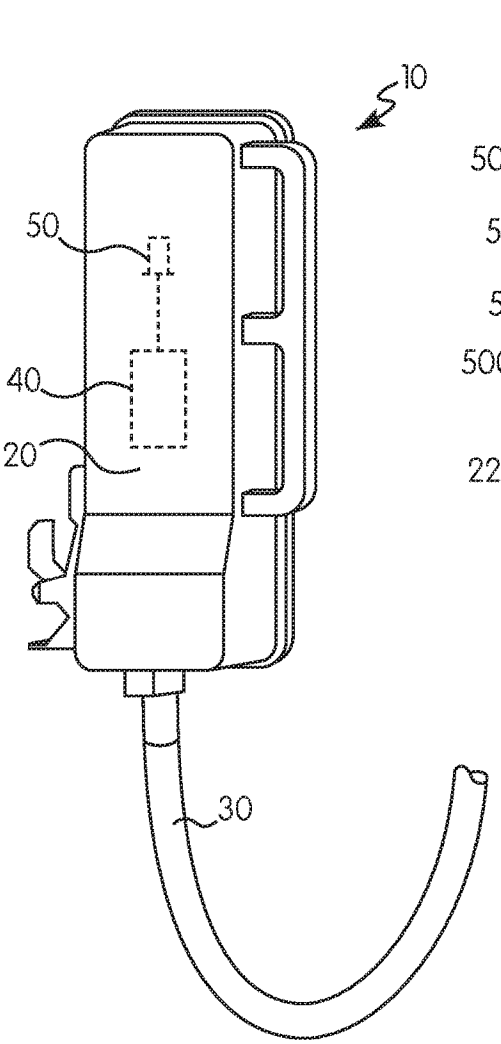
FIG. 1 (Prior Art)
FIG. 1 is a perspective view of an existing EOT device.

FIG. 1 shows a typical EOT device 10 known in the art. The known EOT device 10 includes a hollow enclosure 20 adapted for mounting to a rail car. The enclosure 20 is adapted to receive a hose 30 connected to the brake pipe of a train system. The enclosure 20 houses a radio 40 and an antenna 50 for communicating with a transceiver.

Embodiments of the present invention are generally directed to EOT devices having integrated antennas. Referring now to FIGS. 2-9, the EOT devices 100 according to embodiments of the present invention generally include an enclosure 200 housing one or more communication devices, such as one or more transmitters 300. The enclosure 200 may be at least partially hollow, with the one or more transmitters 300 housed in an interior cavity defined by the enclosure 200. The enclosure 200 defines a port 210 adapted to receive an air brake hose 400 in communication with a brake pipe of a train system.

The one or more transmitters 300 are in communication with one or more antennas 500 configured to transmit a signal from the one or more transmitters 300 to a remote transceiver. Each of the one or more transmitters 300 may be in communication with one of the one or more antennas 500, and/or each of the one or more transmitters 300 may be in communication with two or more of the one or more antennas 500, and/or each of the one more antennas 500 may be in communication with two or more of the one or more transmitters 300.

The enclosure 200 may include or define one or more handles 220 extending from one or more sidewalls 222 of the enclosure 200. Each handle 220 may include one more gripping portions 224 spaced apart from the corresponding sidewall 222 of the enclosure 200 by one or more struts 226.

As shown in the embodiments of FIGS. 2-9, the one or more antennas 500 may be arranged in various configurations with respect to the enclosure 200, the one or more handles 220, and the air brake hose 400. Additionally, each of the one or more antennas 500 may be of monopole, dipole, or other configuration. Moreover, the one or more antennas 500 may include any combination of primary, diversity, and/or other communication types.

Figure 2:
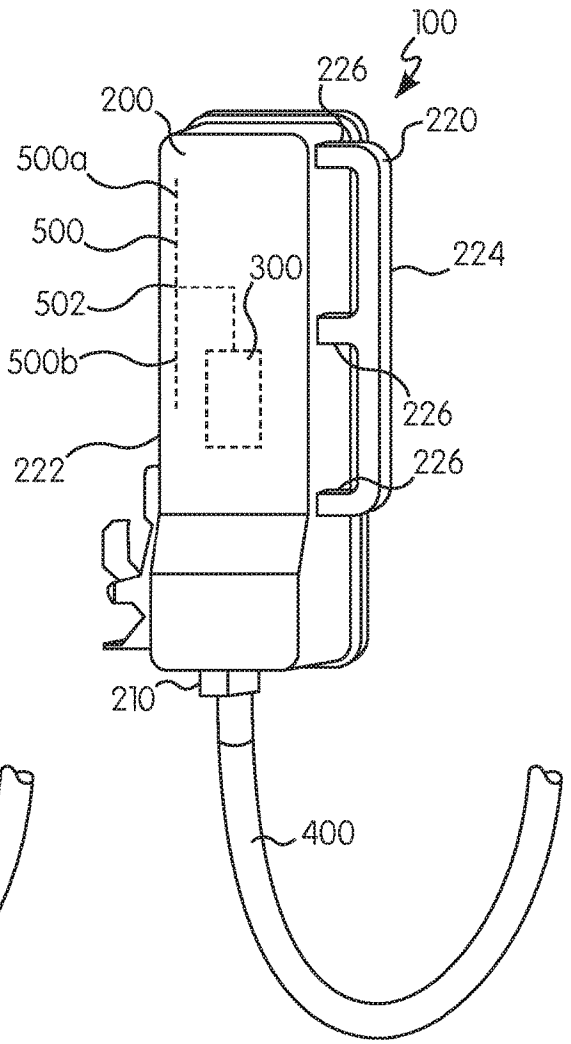
FIG. 2 is a perspective view of an EOT device according to an embodiment of the present invention.

In the embodiment of the EOT device 100 shown in FIG. 2, the one or more antennas 500 include(s) a single antenna in communication with a single transmitter 300 and embedded in one or more of the sidewalls 222 of the enclosure 200. The single antenna 500 is shown as a dipole antenna having a first conductor rod 500*a* and a second conductor rod 500*b* attached at a junction 502. The first and second conductor rods 500*a*, 500*b* of the antenna 500 are protected from the external environment by being embedded within the one or more sidewalls 222 of the enclosure 200. The conductor rods 500*a*, 500*b* may each extend as long as is practical, dictated by the size of the one or more sidewalls 222 of the enclosure 200, or as long as is required to achieve a desired range of communication. Though not shown, the conductor rods 500*a*, 500*b* may extend uninterrupted through and/or across multiple of the one or more sidewalls 222 of the enclosure 200.

In the embodiment of the EOT device 100 shown in FIG. 3, the one or more antennas 500 include(s) a single antenna in communication with a single transmitter 300 and embedded in the air brake hose 400. In some embodiments, the single antenna 500 may be integrally formed with the air brake hose 400 and passed through the port 210 of the enclosure 200 when the air brake hose 400 is attached to the EOT device 100. The single antenna 500 is shown as a monopole antenna having a single conductor rod 500*a*. The conductor rod 500*a* of the antenna 500 is protected from the external environment by being embedded within the air brake hose 400. The conductor rod 500*a* may extend as long as is practical, dictated by the length of the air brake hose 400, or as long as is required to achieve a desired range of communication.

Figure 4:
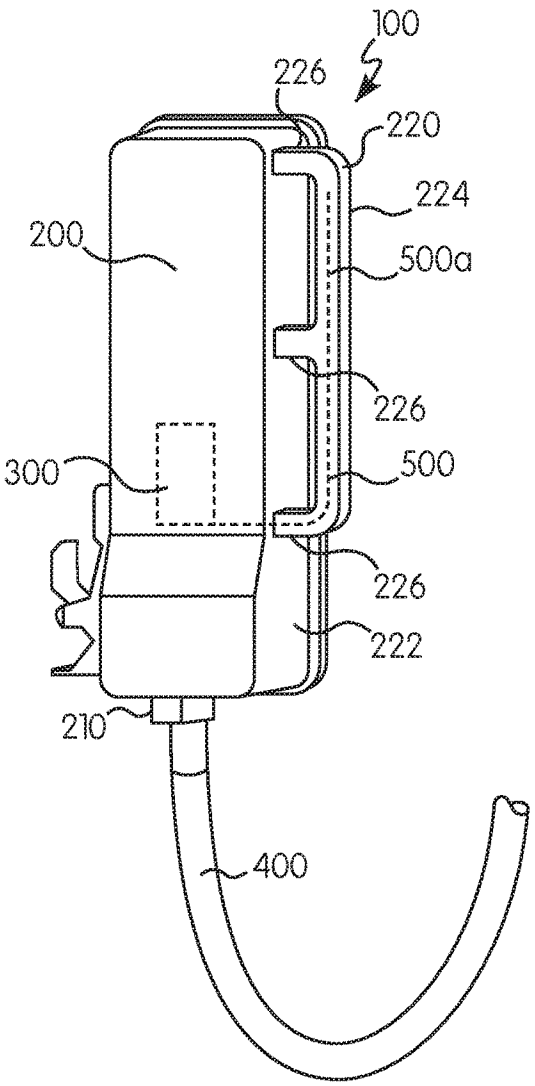
FIG. 4 is a perspective view of an EOT device according to an embodiment of the present invention.

In the embodiment of the EOT device 100 shown in FIG. 4, the one or more antennas 500 include(s) a single antenna embedded in one of the handles 220 of the enclosure 200. The single antenna 500 is in communication with a single transmitter 300 and passes through one of the sidewalls 222 of the enclosure, through an internal cavity of one of the struts 226, and into the gripping portion 224 of the handle 220. The single antenna 500 is shown as a monopole antenna having a single conductor rod 500*a*. The single conductor rod 500*a* of the antenna 500 is protected from the external environment by being embedded within the handle 220 of the enclosure 200. The conductor rods 500*a* may each extend as long as is practical, dictated by the size of the handle 220 of the enclosure 200, or as long as is required to achieve a desired range of communication.

Figure 5:
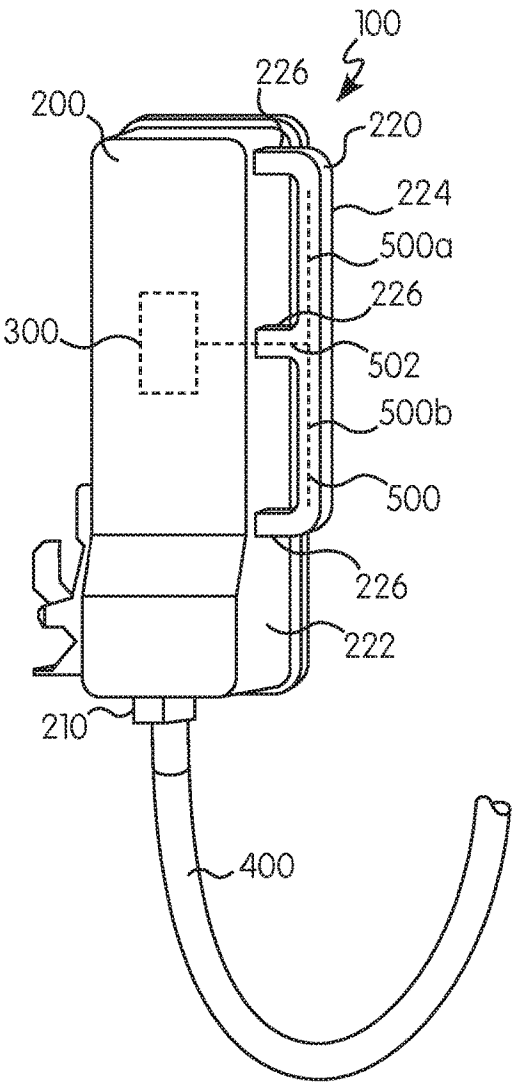
FIG. 5 is a perspective view of an EOT device according to an embodiment of the present invention.

The embodiment of the EOT device 100 shown in FIG. 5 is similar to the embodiment shown in FIG. 4, except that the single antenna 500 is shown as a dipole antenna having a first conductor rod 500*a* and a second conductor rod 500*b* attached at a junction 502. The single antenna 500 passes through the strut 226 located generally near a midpoint of the handle 220 to equalize the length of the first and second conductor rods 500*a*, 500*b* extending in opposite directions in the handle 220. Other than the difference noted above, the embodiment of FIG. 5 may be identical to the embodiment of FIG. 4.

Figure 6:
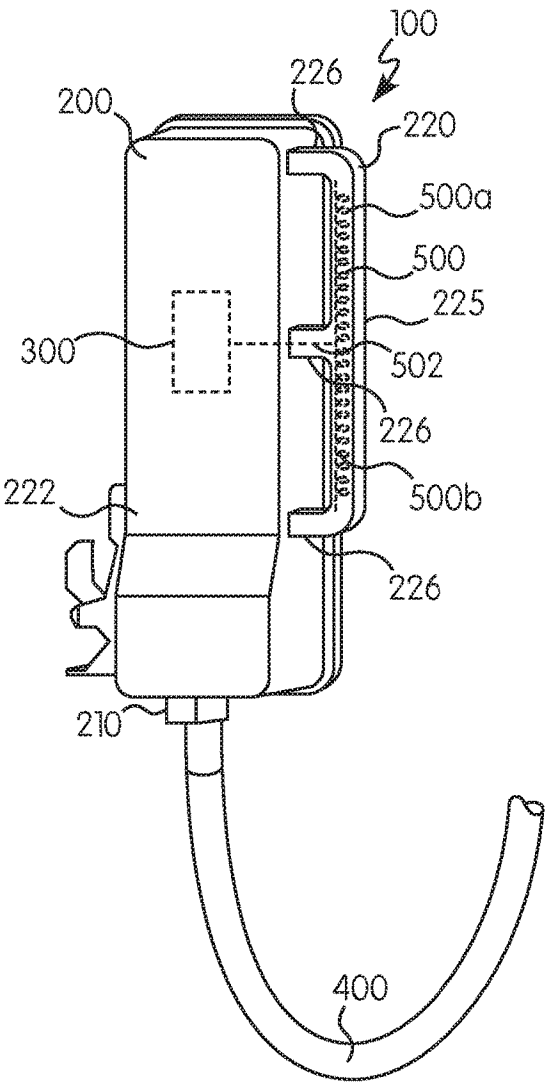
FIG. 6 is a perspective view of an EOT device according to an embodiment of the present invention.

The embodiment of the EOT device 100 shown in FIG. 6 is substantially identical to the embodiment of FIG. 5, except that the first and second conductor rods 500*a*, 500*b* of the single antenna 500 are in a helical dipole configuration.

Figures 7, 8, 9:
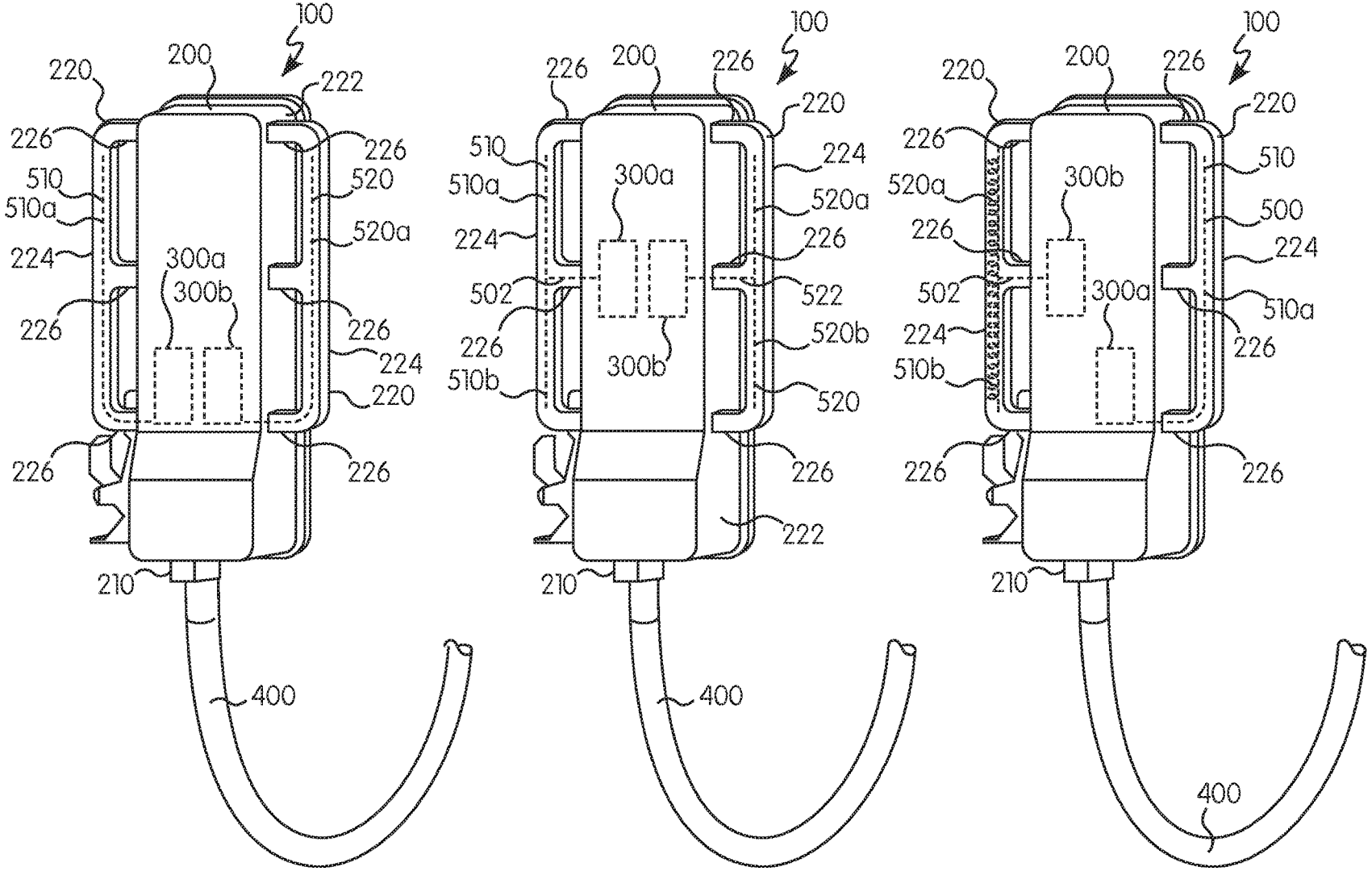
FIG. 7 is a perspective view of an EOT device according to an embodiment of the present invention.
FIG. 8 is a perspective view of an EOT device according to an embodiment of the present invention.
FIG. 9 is a perspective view of an EOT device according to an embodiment of the present invention.

The embodiment of the EOT device 100 shown in FIG. 7 is similar to the embodiment shown in FIG. 4 except that the one or more antenna(s) 500 include(s) a first antenna 510 and a second antenna 520. The first and second antennas 510, 520 are, respectively, in communication with a first transmitter 300*a* and a second transmitter 300*b*. Each of the first and second antennas 510, 520 passes through one of the sidewalls 222 of the enclosure, through an internal cavity of one of the struts 226, and into the gripping portion 224 of one of the handles 220. The first and second antennas 510, 520 are shown as monopole antennas, each having a single conductor rod 510*a*, 510*b*. The first antenna 510 may serve as a primary antenna while the second antenna 520 may serve as a diversity antenna. The single conductor rods 510*a*, 510*b* of the first and second antennas 510, 520 are protected from the external environment by being embedded within the handles 220 of the enclosure 200. The conductor rods 510*a*, 510*b* may each extend as long as is practical, dictated by the size of the handles 220 of the enclosure 200, or as long as is required to achieve a desired range of communication.

The embodiment shown in FIG. 8 is similar to the embodiment shown in FIG. 7, except that each of the first and second antennas 510, 520 are shown as dipole antennas. The first antenna 510 has a first conductor rod 510*a* and a second conductor rod 510*b* attached at a junction 512. The second antenna 520 has a first conductor rod 520*a* and a second conductor rod 520*b* attached at a junction 522. The first and second antennas 510, 520 each pass through a strut 226 located generally near a midpoint of the handles 220 to equalize the length of the first conductor rods 510*a*, 520*a* and the second conductor rods 510*b*, 520*b* extending in opposite directions in the respective handles 220. Other than the difference noted above, the embodiment of FIG. 8 may be identical to the embodiment of FIG. 7

In the embodiment shown in FIG. 9, the one or more antennas 500 include(s) a first antenna 510 and a second antenna 520. The first and second antennas 510, 520 are, respectively, in communication with a first transmitter 300*a* and a second transmitter 300*b*. Each of the first and second antennas 510, 520 passes through one of the sidewalls 222 of the enclosure, through an internal cavity of one of the struts 226, and into the gripping portion 224 of one of the handles 220. The first antenna 510 is shown as a monopole antenna having a single conductor rod 510*a*. The second antenna 520 is shown as a helical dipole antenna having first and second conductor rods 520*a*, 520*b* connected at a junction 522. The first antenna 510 may serve as a primary antenna, while the second antenna 520 may serve as a diversity antenna. The conductor rods 510*a*, 520*a*, 520*b* of the first and second antennas 510, 520 are protected from the external environmental by being embedded within the handles 220 of the enclosure 200. The conductor rods 510*a*, 510*b* may each extend as long as is practical, dictated by the size of the handles 220 of the enclosure 200, or as long as is required to achieve a desired range of communication.

The embodiments shown in FIGS. 2-9 are intended as exemplary only, and various combinations and modifications to the embodiments shown may be appreciated by those skilled in the art and are to be considered within the scope of the present disclosure. For example, any of the one or more antennas 500 which are shown in FIGS. 2-9 as monopole antennas may be substituted with a dipole or other configuration of antenna, and vice versa. Similarly, any of the embodiments of FIGS. 2-9 showing a primary antenna 510 and a diversity antenna 520 may be modified such that the roles of the primary and diversity antennas 510, 520 are switched. Moreover, the present disclosure is not limited to primary and diversity antennas, and other types of antennas may be readily added to or substituted for any of the one or more antennas 500 shown in FIGS. 2-9. Further, each of the one or more antennas 500 may be embedded in more than one of the sidewalls 222 of the enclosure 200, the handles 220 of the enclosure 200, and the air brake hose 400. The one or more antennas 500 may additionally or alternatively be embedded in one or more other components of the EOT device 100 without departing from the scope of the present disclosure.

Additionally, any of the embodiments shown in FIGS. 2-9 may be combined with a known EOT device 10 as shown in FIG. 1. In particular, the EOT device 100 of any of FIGS. 2-9 may be modified to include an antenna 50 of the known EOT device 10 of FIG. 1 in communication with the at least one transmitter 300.

Figure 10:
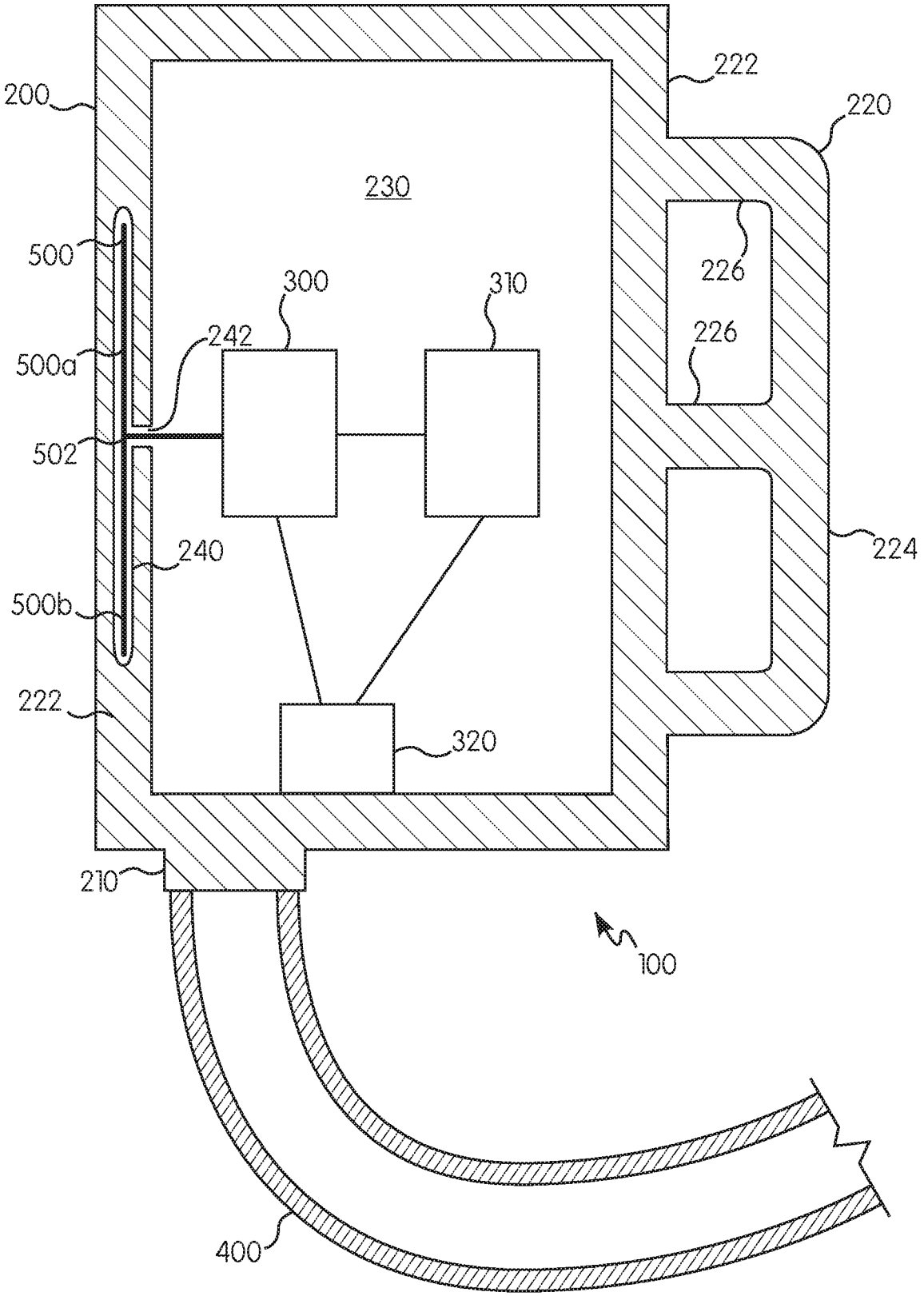
FIG. 10 is a cross-section view of the EOT device of FIG. 2.
Figure 11:
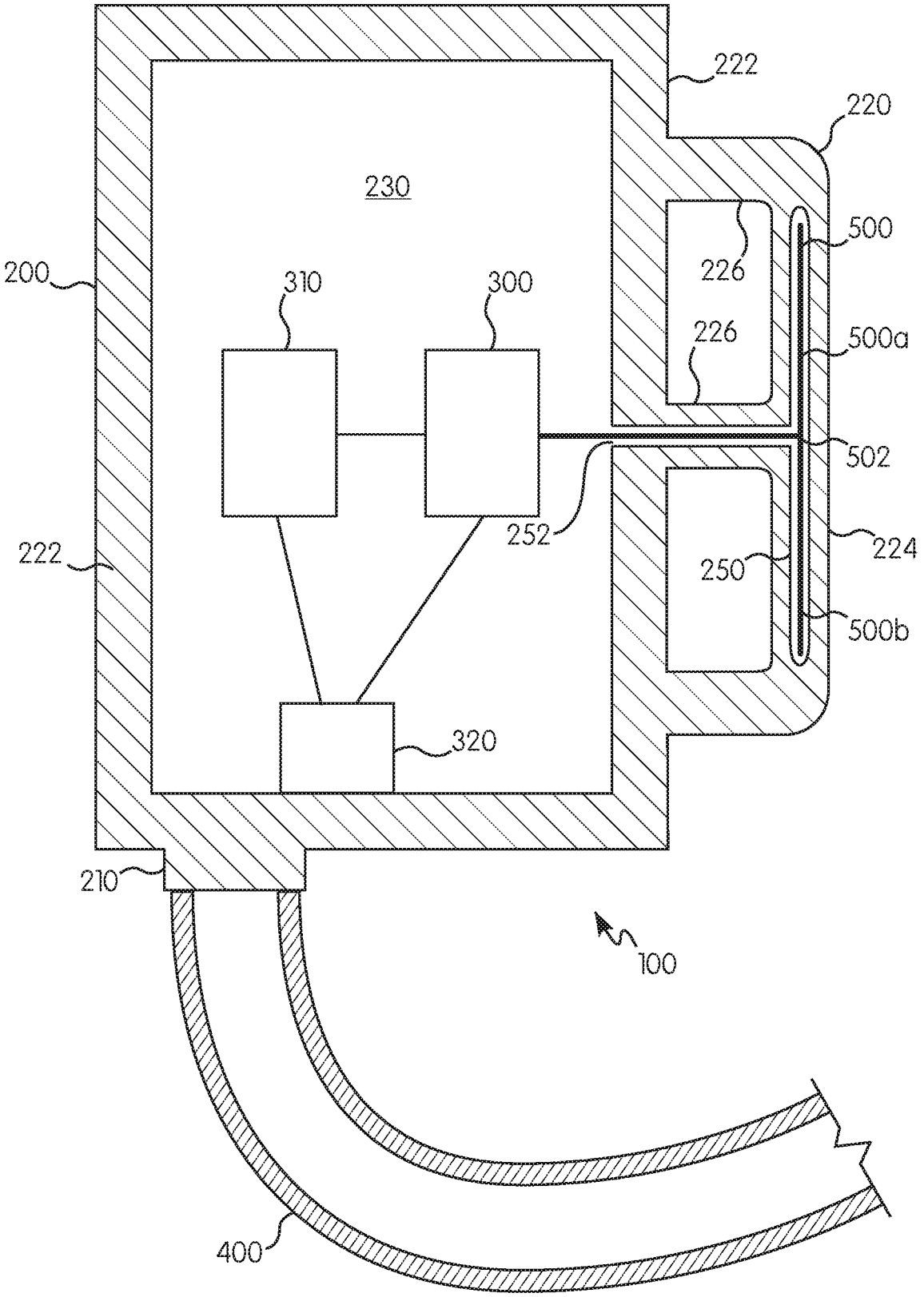
FIG. 11 is a cross-section view of the EOT device of FIG. 5.
Figure 12:
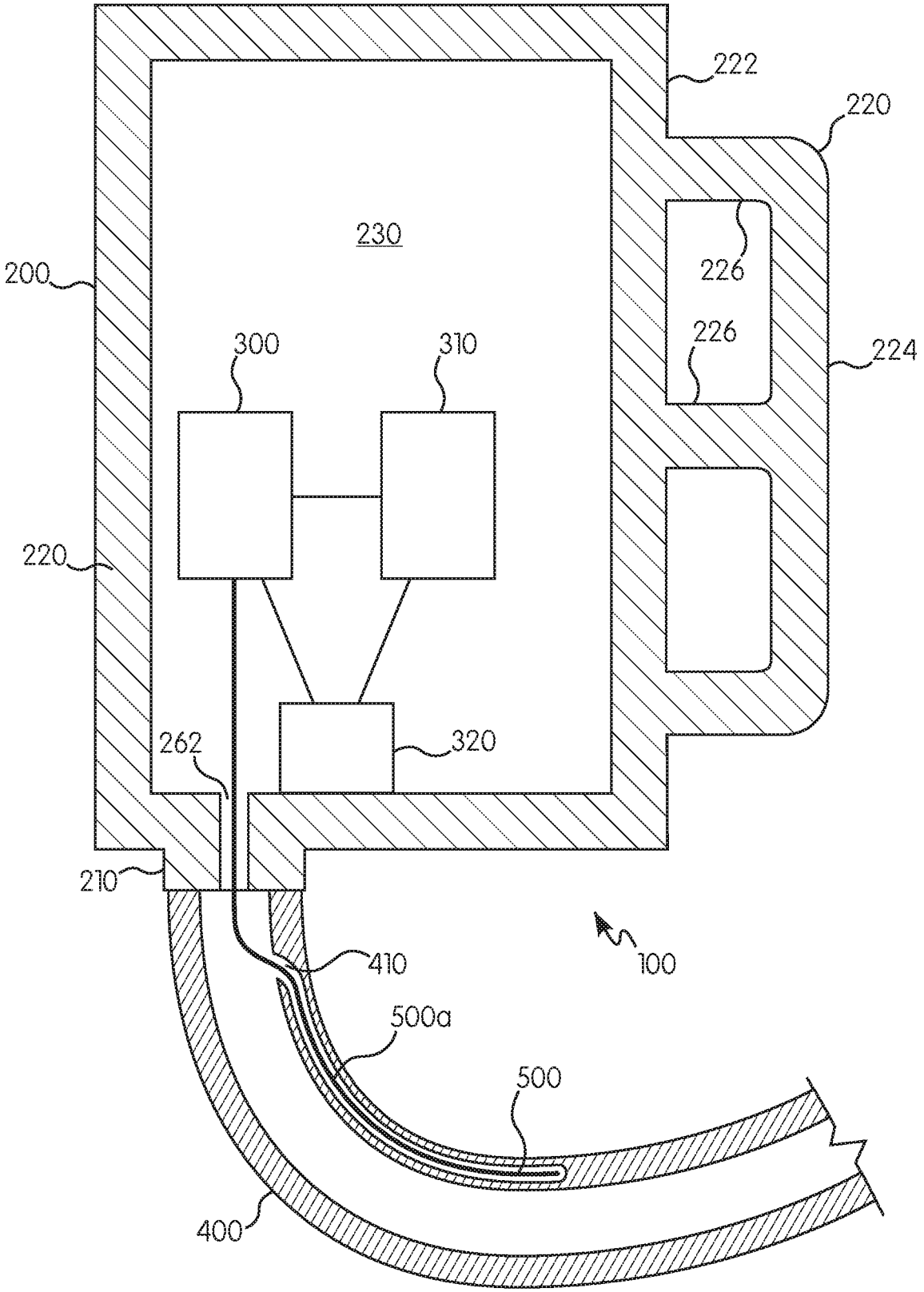
FIG. 12 is a cross-section view of the EOT device of FIG. 3.

Referring now to FIGS. 10-12, cross-section views of various embodiments of the EOT device 100 are shown to illustrate the arrangement of the one or more antennas 500. The cross-section view of FIG. 10 generally corresponds to the embodiment of the EOT device 100 shown in FIG. 2. As shown in FIG. 10, the sidewalls 222 of the enclosure 200 define an internal compartment 230 in which the transmitter 300 is housed. The transmitter 300 is in communication with the one or more antennas 500, at least one processor 310, and a pressure sensor 320. The pressure sensor 320 is mounted in the internal compartment 230 in fluid communication with the port 210. The pressure sensor 320 is adapted to measure the air pressure received at the EOT device 100 via the air brake hose 400. The pressure sensor 320 transmits a signal to the at least one processor 310, which processes the signal and/or transmits the signal to transmitter 300. In some embodiments of the EOT device 100, any of the transmitter 300, the at least one processor 310, and the pressure sensor 320 may be integrated into a single processing unit.

With continued reference to FIG. 10, the antenna 500 is at least partially disposed in one or more sidewalls 222 of the enclosure 200. In particular, the one or more sidewalls 222 define a cavity 240 in which the conducting rods 500*a*, 500*b* of the antenna 500 are disposed. The cavity 240 may be connected to the internal compartment 230 of the enclosure 200 via a channel 242 also defined in the one or more sidewalls 222. The antenna 500 may pass through the channel 242 for connection to the transmitter 300 within the internal compartment 230. In some embodiments, the cavity 240 and the channel 242 may be machined or otherwise formed in the one or more sidewalls 222 prior to the antenna 500 being disposed in the cavity 240 and the channel 242. The antenna 500 may then be inserted into the cavity 240 via the channel 242 during assembly of the EOT device 100. In other embodiments, the antenna 500 may be integrally formed into the one or more sidewalls 222 during a molding or other forming process for manufacturing the enclosure 200, such that the cavity 240 and the channel 242 are defined by and/or around the antenna 500. In some embodiments, the antenna 500 may be integrally molded into the one or more sidewalls 222 such that cavity 240 and the channel 242 are defined as the material forming the one or more sidewalls 222 flows against and encases the antenna 500 during the molding process. The antenna 500 is thus in direct contact with the material of the one or more sidewalls 222, such that no gap is present between the antenna 500 and the material of the one or more sidewalls 222. In such embodiments, the cavity 240 and the channel 242 may thus be entirely occupied by the antenna 500.

The cross-section view of FIG. 11 generally corresponds to the embodiment of the EOT device 100 shown in FIG. 5. The arrangement of the transmitter 300, the at least one processor 310, and the pressure sensor 320 within the internal compartment 230 of the enclosure 200 is substantially as described above with reference to FIG. 10. The antenna 500 is at least partially disposed in one or more of the handles 220 of the enclosure 200. In particular, the one or more handles 220 define a cavity 250 in which the conducting rods 500*a*, 500*b* of the antenna 500 are disposed. The cavity 250 may be located in the gripping portion 224 of the handle 220, the struts 226 of the handle 220, or a combination thereof. The cavity 250 may be connected to the internal compartment 230 of the enclosure 200 via a channel 252 also defined in one or more of the struts 226. The antenna 500 may pass through the channel 252 for connection to the transmitter 300 within the internal compartment 230. In some embodiments, the cavity 250 and the channel 252 may be machined or otherwise formed in the one or more handles 220 prior to the antenna 500 being disposed in the cavity 250 and the channel 252. The antenna 500 may then be inserted into the cavity 250 via the channel 252 during assembly of the EOT device 100. In other embodiments, the antenna 500 may be integrally formed into the one or more handles 220 during a molding or other forming process for manufacturing the handles 220 such that the cavity 250 and the channel 252 are defined by and/or around the antenna 500. In some embodiments, the antenna 500 may be integrally molded into the one or more handles 220 such that cavity 250 and the channel 252 are defined as the material forming the one or more handles 220 flows against and encases the antenna 500 during the molding process. The antenna 500 is thus in direct contact with the material of the one or more handles 220, such that no gap is present between the antenna 500 and the material of the one or more handles 220. In such embodiments, the cavity 250 and the channel 252 may thus be entirely occupied by the antenna 500.

The cross-section view of FIG. 12 generally corresponds to the embodiment of the EOT device 100 shown in FIG. 3. The arrangement of the transmitter 300, the at least one processor 310, and the pressure sensor 320 within the internal compartment 230 of the enclosure 200 is substantially as described above with reference to FIG. 10. The antenna 500 is at least partially disposed in the air brake hose 400. In particular, a flexible wall of the air brake hose 400 defines a cavity 410 in which the conductor rod 500*a* of the antenna 500 is disposed. The cavity 410 may extend from an end of the air brake hose 400 connected to the port 210 of the enclosure 200. The port 210 may further define a channel 262 connecting to cavity 410 of the air brake hose 400 with the internal compartment 230 of the enclosure 200. The antenna 500 may pass through the channel 262 for connection to the transmitter 300 within the internal compartment 230. In some embodiments, the cavity 410 may be formed in the air brake hose 400 prior to the antenna 500 being inserted into the cavity 410, i.e., during manufacturing of the air brake hose 400. The antenna 500 may then be inserted into the cavity 410 via the channel 262 during assembly of the EOT device 100. In other embodiments, the antenna 500 may be integrally formed into the air brake hose 400 during a molding, braiding, wrapping, or other forming process of the air brake hose 400 such that the cavity 410 is defined around the antenna 500.

In some embodiments, the antenna 500 may be integrally molded into the air brake hose 400 such that cavity 410 is defined as the material forming the air brake hose 400 flows against and encases the antenna 500 during the molding process. The antenna 500 is thus in direct contact with the material of the air brake hose 410, such that no gap is present between the antenna 500 and the material of the air brake hose 400. In other embodiments, the antenna may be integrally formed with the air brake hose 400 by braiding or winding the material of the air brake hose 400 around the antenna 500. Again, the antenna 500 is thus in direct contact with the material of the air brake hose 410, such that no gap is present between the antenna 500 and the material of the air brake hose 400. In such embodiments, the cavity 410 and the channel 242 may thus be entirely occupied by the antenna 500. Similarly, the channel 262 of the port 210 may be integrally molded into the enclosure as the same manner as discussed above with respect to the channel 242 of the sidewalls 222 and the channel 252 of the handle 220.

FIGS. 10-12 are intended to be illustrative of various embodiments of EOT devices 100 but are not to be construed as limiting. The cavity 240 and the channel 242 of the one or more sidewalls 222 may be readily adjusted based on the size, type, and configuration of the one or more antennas 500. For example, the location of the channel 242 shown in FIG. 10 is generally located centrally in sidewall 222 to balance the respective lengths of the first and second conducting rods 500*a*, 500*b* of the dipole antenna 500. However, the channel 242 may be readily located toward an end of the sidewall 222 in an embodiment having a monopole antenna 500 with only a single conducting rod 500*a* in order to maximize the length of the conducting rod 500*a*. Similarly, with respect to FIG. 11, the channel 252 of the handle 220 may be relocated from the central strut 226 as shown to the lower or upper strut 226 to better accommodate a monopole antenna 500. Moreover, in embodiments of the EOT device 100 having multiple antennas 500, a plurality of the cavities 240 and the channels 242 in the sidewalls 222, the cavities 250, and the channels 252 in the handles 220, and/or the cavity 410 in the air brake hose 400, may be implemented in any combination to accommodate the multiple antennas 500. One skilled in the art will readily appreciate these and similar variations which are understood to be within the scope of the present disclosure.

Figure 13:
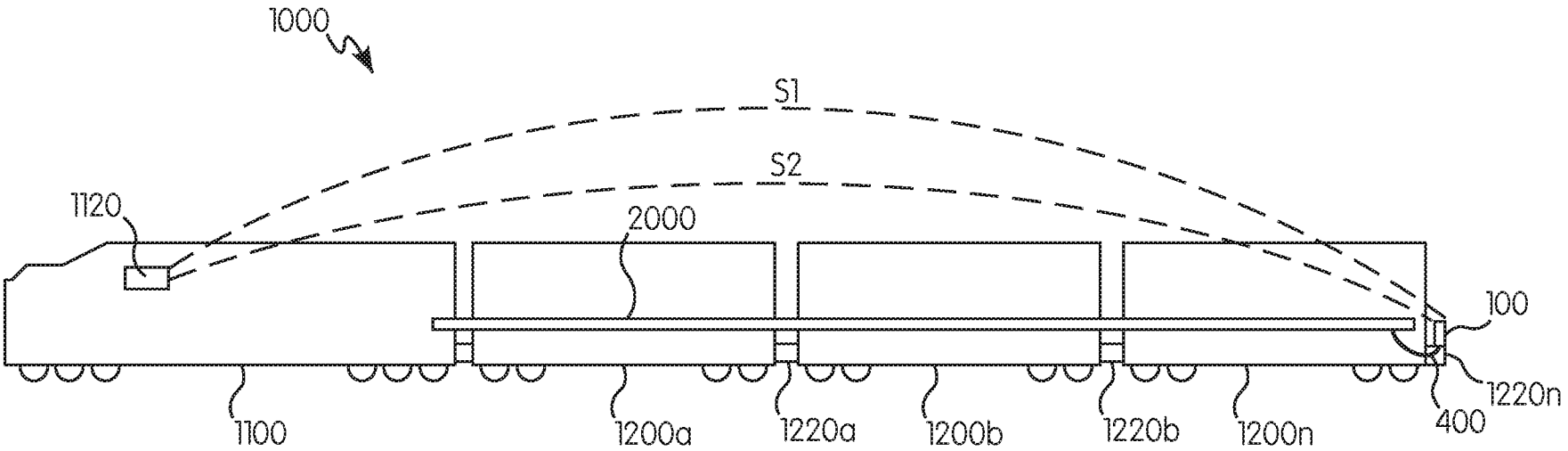
FIG. 13 is a schematic of a train system according to an embodiment of the present invention.

Referring now to FIG. 13, embodiments of the EOT devices 100 as described with reference to FIGS. 1-12 may implemented into a train system 1000 including a consist of at least one locomotive 1100 and a plurality of rail cars 1200*a*-1200*n* connected in series via a coupler 1220*a*-1220*n* of each of the rail cars 1200*a*-1200*n*. A brake pipe 2000 may extend along the length of the consist and may have a branch connection at each of the rail cars 1200*a*-1200*n* to supply air brake pressure to each rail car 1200*a*-1200*n*. The brake pipe 2000 is shown schematically in FIG. 13 but may include a plurality of rigid sections and solid sections along the length of the consist. The EOT device 100 according to any of the embodiments described above may be affixed to the coupler 1220*n* of the trailing rail car 1200*n* and connected to the air brake hose 400 branching from the brake pipe 2000. The locomotive 1100 may include a receiver 1120 in wireless communication with the EOT device 100 via the one or more transmitters 300. In particular, the receiver 1120 of the locomotive 1100 is adapted to receive one or more communication signals S1, S2 generated by the one or more transmitters 300 and transmitted via the one or more antennas 500. The one or more communication signals S1, S2 may include, for example, brake pressure data indicating the air brake pressure measured by the pressure sensor 320. If the one or more communication signals S1, S2 received by the receiver 1120 of the locomotive 1100 indicate(s) an abnormally low brake pressure, a control unit or operator onboard the locomotive 1100 can take corrective action, such as stopping the train system 1000. In this manner, the implementation of the EOT device 100 in the train system 1000 may be used by the control unit or operator to detect abnormal brake pressure drops in the air brake hose 400.

In embodiments of the EOT device 100 having a single antenna 500, such as the EOT devices shown in FIGS. 2-6, only one communication signal S1 may be transmitted by the antenna 500 and received by the receiver 1120 of the locomotive 1100. In embodiments of the EOT device 100 having multiple antennas 500, such as the EOT devices 100 shown in FIGS. 7-9, the first antenna 510 may transmit a first of the communication signals S1 and the second antenna 520 may transmit a second of the communication symbols S2. In such embodiments, the first antenna 510 may be a primary antenna and the second antenna 520 may be a diversity antenna.

The one or more antennas 500 used in the various embodiments of the EOT device 100 described herein may be selected to obtain desirable communication properties such as length, gain, and/or frequency. For example, the one or more antennas 500 may be ½ wavelength or 1¼ wavelength dipole antennas. In one embodiment, the antenna 500 may be approximately 13 inches long and have a peak gain of approximately 5.1 dBi. These properties of the one or more antennas 500 may be particularly selected based on the distance between the antennas 500 of the EOT device 100 and the receiver 1120 of the locomotive 1100 in the train system 1000.

While several examples of EOT devices and an implementation of the same in a train system are shown in the accompanying figures and described in detail hereinabove, other examples will be apparent to and readily made by those skilled in the art without departing from the scope and spirit of the present disclosure. For example, it is to be understood that aspects of the various embodiments described hereinabove may be combined with aspects of other embodiments while still falling within the scope of the present disclosure. Accordingly, the foregoing description is intended to be illustrative rather than restrictive. The assembly of the present disclosure described hereinabove is defined by the appended claims, and all changes to the disclosed assembly that fall within the meaning and range of equivalency of the claims are to be embraced within their scope.

The invention claimed is:

1. An end-of-train (EOT) device adapted for attachment to a coupler of a trailing rail vehicle of a rail vehicle system, the EOT device comprising:

an enclosure defining an internal compartment;

a handle extending from the enclosure;

at least one communication device disposed within the internal compartment of the enclosure; and at least one antenna connected to the at least one communication device, the at least one antenna extending into the internal compartment of the enclosure and into the handle, the at least one antenna configured to communicate signals from the at least one communication device to another rail vehicle of the rail vehicle system, the at least one antenna including a dipole antenna having conducting rods attached to one another at a junction.

2. The EOT device of claim 1, wherein the at least one antenna comprises a monopole antenna including a single conducting rod.

3. The EOT device of claim 1, wherein the at least one antenna comprises a primary antenna and a diversity antenna.

4. The EOT device of claim 3, wherein the at least one communication device comprises a first communication device connected to the primary antenna and a second communication device connected to the diversity antenna.

5. The EOT device of claim 1, wherein the handle includes a gripping portion and struts, the gripping portion spaced apart from the enclosure via the struts, the at least one antenna extending through at least one of the struts and into the gripping portion of the handle.

6. The EOT device of claim 5, wherein the struts of the handle include a midpoint strut, a first strut, and a second strut with the midpoint strut between the first strut and the second strut.

7. The EOT device of claim 6, wherein the at least one antenna extends from the internal compartment of the enclosure, through the first strut, and into the gripping portion of the handle past the midpoint strut.

8. The EOT device of claim 6, wherein the at least one antenna includes a dipole antenna having a first conductor rod and a second conductor rod coupled with each other at a junction that is in the gripping portion of the handle.

9. The EOT device of claim 8, wherein the at least one antenna extends from the internal compartment of the enclosure, through the midpoint strut, and to the junction disposed in the gripping portion of the handle with the first conductor rod extending in the gripping portion of the handle from the junction toward the first strut and the second conductor rod extending in the gripping portion of the handle from the junction toward the second strut.

10. The EOT device of claim 1, wherein the handle is a first handle and the at least one antenna includes a first antenna and a second antenna, and further comprising:

a second handle extending from the enclosure, the first antenna extending from the at least one communication device inside the enclosure and into the first handle, the second antenna extending from the at least one communication device inside the enclosure and into the second handle.

11. The EOT device of claim 10, wherein the first handle and the second handle are on opposite sides of the enclosure.

12. The EOT device of claim 10, wherein the at least one communication device includes a first communication device and a second communication device, the first antenna extending from the first communication device, the second antenna extending from the second communication device.

13. The EOT device of claim 10, wherein the first antenna includes a monopole antenna having a first conductor rod and the second antenna includes a helical dipole antenna having second and third conductor rods connected at a junction disposed in the first handle.

14. An end-of-train (EOT) device configured to be coupled with a first rail vehicle of a rail vehicle system, the EOT device comprising:

an enclosure defining an internal compartment and including a handle having a gripping portion spaced apart from the enclosure and connected with the enclosure by struts;

at least one communication device disposed within the internal compartment of the enclosure;

at least one antenna connected to the at least one communication device, the at least one antenna extending through the internal compartment of the enclosure and into the handle through one or more of the struts, the at least one antenna configured to communicate signals from the at least one communication device to a second rail vehicle of the rail vehicle system; and wherein the at least one antenna comprises a dipole antenna including conducting rods attached to one another at a junction disposed within the handle.

15. The EOT device of claim 14, wherein the handle is a first handle and the at least one antenna includes a first antenna and a second antenna, and further comprising:

a second handle extending from the enclosure, the first antenna extending from the at least one communication device inside the enclosure and into the first handle, the second antenna extending from the at least one communication device inside the enclosure and into the second handle, the first handle and the second handle disposed on opposite sides of the enclosure, the at least one communication device including a first communication device and a second communication device, the first antenna extending from the first communication device, the second antenna extending from the second communication device, wherein the first antenna including a monopole antenna having a first conductor rod and the second antenna includes a helical dipole antenna having second and third conductor rods connected at a junction disposed in the second handle.

16. An end-of-train (EOT) device configured to be coupled with a first rail vehicle of a rail vehicle system, the EOT device comprising:

an enclosure defining an internal compartment and including first and second handles on opposite sides of the enclosure, each of the first and second handles having a gripping portion spaced apart from the enclosure and connected with the enclosure by struts;

first and second communication devices disposed within the internal compartment of the enclosure;

a first antenna connected to the first communication device, the first antenna extending through the internal compartment of the enclosure and into the first handle through a first strut of the struts of the first handle, the first antenna configured to communicate first signals from the first communication device to a second rail vehicle of the rail vehicle system; and a second antenna connected to the second communication device, the second antenna extending through the internal compartment of the enclosure and into the second handle through a second strut of the struts of the second handle, the second antenna configured to communicate second signals from the second communication device to the second rail vehicle of the rail vehicle system.

17. The EOT device of claim 16, wherein the first handle is coupled to the enclosure by the struts that include a first strut, a second strut, and a first midpoint strut disposed between the first strut and the second strut, the second handle coupled to the enclosure by the struts that include a third strut, a fourth strut, and a second midpoint strut disposed between the third strut and the fourth strut, wherein the first antenna extends from the first communication device, through the first midpoint strut, and through the first handle toward both the first strut and the second strut, wherein the second antenna extends from the second communication device, through the third strut, and through the second handle toward the fourth strut past the second midpoint strut.

* * * * *